US008844260B2

(12) United States Patent
Beran et al.

(10) Patent No.: US 8,844,260 B2
(45) Date of Patent: Sep. 30, 2014

(54) LOW CALORIFIC FUEL COMBUSTOR FOR GAS TURBINE

(75) Inventors: Martin Beran, Prague (CZ); Michal Koranek, Hengelo (NL); Axel Lars-Uno Eugen Axelsson, Hengelo (NL)

(73) Assignee: Opra Technologies B.V. (NL)

( * ) Notice: Subject to any disclaimer, the term of this patent is extended or adjusted under 35 U.S.C. 154(b) by 801 days.

(21) Appl. No.: 12/926,321

(22) Filed: Nov. 9, 2010

(65) Prior Publication Data

US 2012/0111014 A1 May 10, 2012

(51) Int. Cl.
*F02C 3/14* (2006.01)

(52) U.S. Cl.
USPC ..... 60/39.37; 60/754; 60/760

(58) Field of Classification Search
USPC ..... 60/39.37, 751–760; 431/10, 12
See application file for complete search history.

(56) References Cited

U.S. PATENT DOCUMENTS

| | | | | |
|---|---|---|---|---|
| 4,339,925 | A * | 7/1982 | Eggmann et al. | 60/757 |
| 6,134,877 | A * | 10/2000 | Alkabie | 60/800 |
| 6,405,536 | B1 | 6/2002 | Ho et al. | |
| 7,975,487 | B2 * | 7/2011 | Lockyer et al. | 60/752 |
| 2004/0261419 | A1 * | 12/2004 | McCaffrey et al. | 60/796 |
| 2009/0120094 | A1 | 5/2009 | Norster | |
| 2009/0282833 | A1 | 11/2009 | Hessler et al. | |
| 2010/0126174 | A1 * | 5/2010 | Brinkmann et al. | 60/737 |
| 2010/0251723 | A1 | 10/2010 | Chen et al. | |
| 2011/0107766 | A1 * | 5/2011 | Davis et al. | 60/755 |

FOREIGN PATENT DOCUMENTS

| | | | |
|---|---|---|---|
| DE | 10 2009 025 795 | A1 | 11/2009 |
| EP | 0 204 553 | A1 | 10/1986 |
| EP | 1 517 088 | A2 | 3/2005 |

OTHER PUBLICATIONS

PCT International Search Report and Written Opinion for International Application No. PCT/IB2011/003030, dated Jun. 5, 2013.

* cited by examiner

*Primary Examiner* — Andrew Nguyen
(74) *Attorney, Agent, or Firm* — Finnegan, Henderson, Farabow, Garrett & Dunner, LLP

(57) ABSTRACT

A low calorific value fuel-fired can combustor for a gas turbine include a generally cylindrical housing, and a generally cylindrical liner disposed coaxially within the housing to define with the housing a radial outer flow passage for combustion air, the liner also defining inner combustion and a dilution zone, the dilution zone being axially distant a closed housing end relative to the combustion zone. A nozzle assembly disposed at the closed housing end includes an air blast nozzle and surrounding swirl vanes. An impingement cooling sleeve coaxially disposed in the combustion air passage between the housing and the liner impingement cools the portion of the liner defining the combustion zone. The combustion liner has an L/D ratio of in the range $1 \leq L/D \leq 4$, and a ratio of the combustion zone volume ($m^3$) to heat energy flow rate Q (MJ/sec) in the range $0.0026 \leq V/Q \leq 0.018$.

20 Claims, 2 Drawing Sheets

LOW CALORIFIC FUEL COMBUSTOR FOR GAS TURBINE

FIELD OF THE INVENTION

The present invention relates to can combustors for gas turbines. In particular, the present invention relates to low calorific liquid and gaseous fuel-fired, impingement cooled can combustors for gas turbine engines.

BACKGROUND OF THE INVENTION

A principle problem with fuels of a relatively low calorific value, e.g., 25 MJ/kg, or less is the lower flame speed that can adversely affect the completion of combustion, particularly for uneven fuel/air mixtures, thus affecting the local fuel/air ratio in the combustor. This problem is particularly pronounced in the case of liquid fuels, where the fuel/air mixtures may have large fuel particle (droplet) sizes, which increase the time required to vaporize and burn the particles.

The achievement of low levels of oxides of nitrogen in combustors is closely related to flame temperature and its variation through the early parts of the reaction zone. Flame temperature is a function of the effective fuel-air ratio in the reaction zone which depends on the applied fuel-air ratio and the degree of mixing achieved before the flame front. These factors are obviously influenced by the local application of fuel and associated air and particularly the effectiveness of mixing.

The use of film cooling in these low flame temperature combustors generates high levels of carbon monoxide emissions and eventually creates sediments. External impingement cooling of the flame tube (liner) can curtail such problems. Moreover, the requirement for stoichiometric combustion requires the air flow to the reaction zone be a small portion of the total air flow, and a large portion of the total air flow be available for the dilution zone. Hence there is a considerable advantage in controlling these flows to optimize the combustion efficiency and minimize the emissions.

Improvements are possible in the configuration of can combustors and in the control of air and air/fuel mixture flows in the can combustors using liquid fuel with a low calorific value, which flows affect the completeness of the burning, and thus the level of emissions and the thermal efficiency of the combustor. Such improvements are set forth hereinafter.

SUMMARY OF THE INVENTION

In an aspect of the present invention, a can combustor is configured for burning fuels with a low calorific value. The combustor includes a generally cylindrical housing having an interior, a longitudinal axis, an annular inlet for receiving compressed air at one longitudinal housing end with the other longitudinal housing end being closed. Also, a generally cylindrical combustor liner is coaxially disposed in the housing interior, the liner and the housing defining a generally annular flow passage for the compressed air received through the housing inlet, and the interior of the liner defining a combustion zone adjacent the closed housing end and a dilution zone distant the closed housing end. The liner is sized to have an L/D ratio of in the range $1 \leq L/D \leq 4$, where L is the liner length and D is the liner diameter, and to provide at a rated power, a ratio of the volume V of the combustion zone in meters$^3$ to the fuel energy flow rate Q in the combustor in MJ/sec in the range $0.0026 \leq V/Q \leq 0.018$. A fuel nozzle assembly is disposed at the closed end, the nozzle assembly being supplied from a source of fuel having a calorific value of less than about 25 MJ/kg. Further, an impingement cooling sleeve is disposed in the compressed air passage surrounding the liner portion defining the combustion zone, the sleeve having a plurality of orifices sized and configured to impingement cool the outer surface of the liner portion. Essentially all of the compressed air received at the housing inlet may pass through the sleeve. A plurality of primary holes are circumferentially disposed in the liner for introducing a first portion of the compressed air from a region downstream of the impingement cooling sleeve into the combustion zone, and a plurality of dilution openings is circumferentially disposed in the liner for introducing a second portion of the compressed air from the region downstream of the impingement cooling sleeve into the dilution zone. Still further, at least part of the remainder portion of the compressed air from the region downstream of the impingement cooling screen is channeled through the fuel nozzle assembly for mixing with the supplied fuel to provide a fuel/air mixture directed into the combustion zone.

The accompanying drawings, which are incorporated in and constitute a part of this specification, illustrate an embodiment of the invention and, together with the description, serve to explain the principles of the invention.

DESCRIPTION OF THE EMBODIMENT

Figure 1:
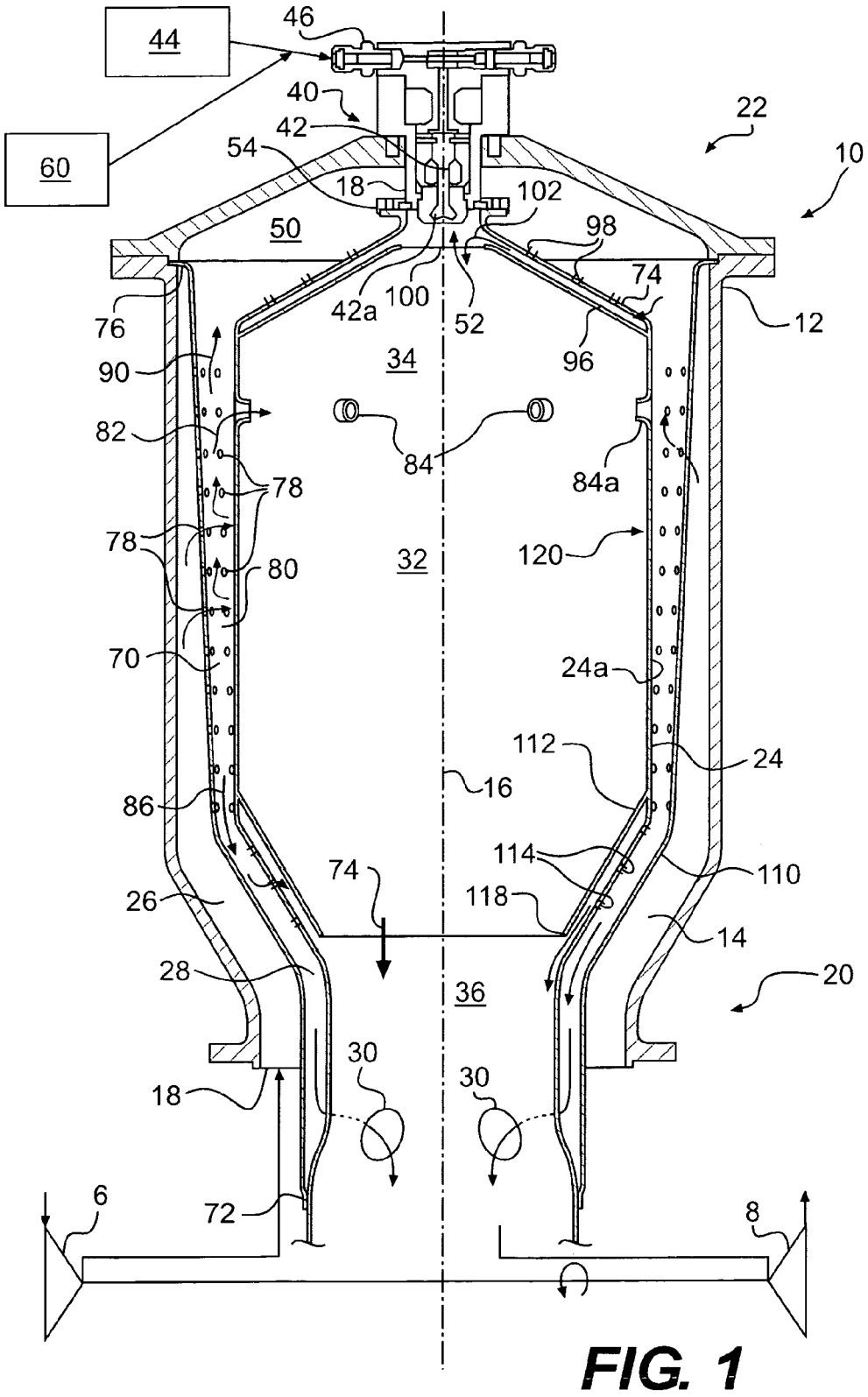
FIG. 1 is a schematic cross-sectional view of a gas turbine can combustor configured for combusting fuel having a low calorific value, in accordance with the present invention.

The can combustor of the present invention, generally designated by the numeral 10 in the figures, is intended for use in combusting fuel having a low calorific value fuel with compressed air from compressor 6, and delivering combustion gases to gas turbine 8, e.g., for work-producing expansion such as in a gas turbine engine. See FIG. 1. Compressor 6 may be a centrifugal compressor and gas turbine 8 may be a radial inflow turbine, but these are merely preferred and are not intended to limit the scope of the present invention, which is defined by the appended claims and their equivalents.

In accordance with the present invention, as embodied and broadly described herein, the can combustor may include a generally cylindrical housing having an interior, a longitudinal, an annular inlet for receiving compressed air at one longitudinal end, axis with the other longitudinal end being closed. As embodied herein, and with reference to FIG. 1, can combustor 10 includes outer housing 12 having interior 14, longitudinal axis 16, annular inlet 18 configured to receive compressed air from compressor 6 at open housing end 20. Housing also includes closed end 22. Housing 12 is generally cylindrical in shape about axis 16, but can include tapered and/or stepped sections of a different diameter in accordance with the needs of the particular application and to accommodate certain features of the present invention to be discussed hereinafter.

In accordance with the present invention, the combustor also includes a generally cylindrical combustor liner coaxially disposed in the housing interior and configured to define with the housing a generally annular passage for the compressed air received through the inlet. The liner also defines respective radially inner volumes for a combustion zone and a dilution zone. The dilution zone is axially distant the closed housing end relative to the combustion zone, and the combustion zone is axially adjacent the closed housing end.

As embodied herein, and with continued reference to FIG. 1, combustor 10 includes combustor liner 24 disposed within housing 12 generally concentrically with respect to axis 16. Liner 24 may be sized and configured to define with housing 12 outer passage 26 for compressed air supplied from engine compressor 6 through inlet 18, to be used for impingement cooling, and thereafter combustion air and dilution air. Liner 24 also partially defines dilution air path 28. In the FIG. 1 embodiment, path 28 for the dilution air includes a plurality of dilution ports 30 distributed about the circumference of liner 24.

Interior 14 of liner 24 defines combustion zone 32 axially adjacent closed end 22, where compressed air and fuel are combusted to produce hot combustion gases. In conjunction with fuel nozzle assembly 40 disposed at closed end 18 (to be discussed hereinafter), liner 24 is configured to provide stable recirculation in upper region 34 of combustion zone 32, in a manner known to those skilled in the art. The interior of liner 24 further defines dilution zone 36 where combustion gases are mixed with dilution air from dilution ports 30 to lower the temperature of the combustion gases, before work-producing expansion in turbine 8.

Figure 2A:
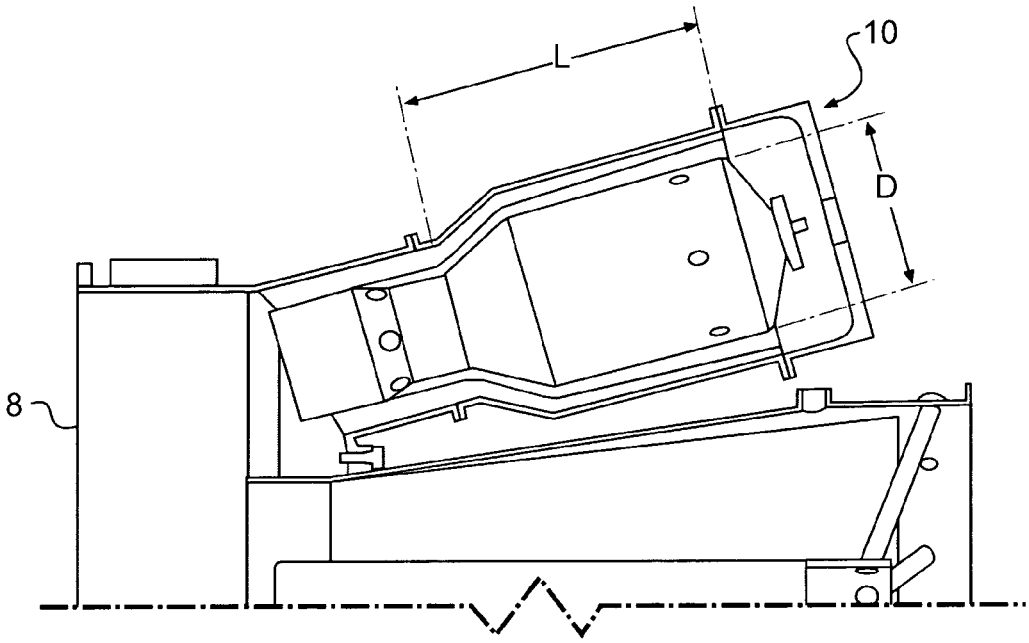
FIGS. 2A and 2B are schematic cross-sections comparing dimensions of the FIG. 1 combustor (FIG. 2A) with those of a prior art combustor (FIG. 2B) in a gas turbine engine application.
Figure 2B:
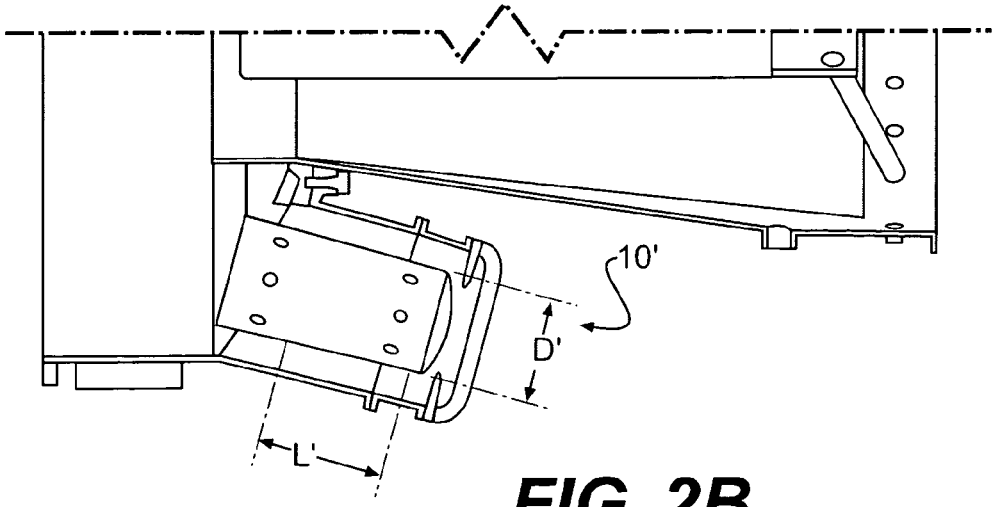
FIG. 2B (PRIOR ART)

With reference now to FIGS. 2A and 2B, a distinguishing feature of the can combusters of the present invention includes the larger size of the combustion zone, compared to conventional can combusters configured to combust equivalent fuel flow rates. Specifically, liner 24 of can combuster 10 of the present invention has a volume approximately four (4) times that of conventional combustors 10' for approximately the same fuel flow at rated power. That is, liner 24, and consequently housing 12, have expanded dimensions for liner length L and/or liner diameter D in the region of combustion zone 32, to achieve an expanded combustion zone volume for an equivalent fuel mass flow at rated power. Specifically, the liner of the present invention may be configured to have a ratio of combustor zone volume V in cubic meters to the heat energy flow rate Q in MJ/sec at rated power in the range $0.0026 \leq V/Q \leq 0.018$, where Q is defined as the calorific value of the fuel in MJ/kg multiplied by the fuel mass flow rate in kg/sec. This increase in combustion zone volume relative to conventional can combustors is expected to increase the average residence time of the fuel/air mixture and also promote vaporization of any fuel droplets when liquid fuel is utilized. Moreover, the liner L/D ratio of combustors constructed in accordance with the present invention may be in the range $1 \leq L/D \leq 4$, and preferably $1.5 \leq L/D \leq 2.5$.

Also in accordance with the present invention, the combustor includes a fuel nozzle assembly disposed at the closed housing end and configured to inject a spray of fuel into the combustion zone. The nozzle assembly may include a nozzle aligned along the liner axis for directing a spray of fuel through an opening into the combustion zone. The nozzle may be an "air blast" nozzle such as is known in the art, in which compressed air is used to "atomize" liquid fuel to provide a spray, i.e. produce very small droplets on the order of about 65 microns in diameter. Such an air blast nozzle also is usable with gaseous fuels to provide better mixing in combustor 10. The nozzle assembly also may have a plurality of swirl vanes circumferentially disposed about the nozzle to induce swirling of the fuel/air mixture.

As embodied herein, and with attention to FIG. 1, nozzle assembly 40 includes air blast nozzle 42 is controllably supplied with low calorific fuel (liquid or gaseous) from source 44 through conduit 46. Nozzle 42 may be aligned along axis 16 and may include openings 48 for admitting compressed air from plenum region 50 between liner 24 and housing 12 at closed housing end 22, to the vicinity of nozzle tip 42*a*, which may be outwardly flared. When used with liquid fuels this nozzle assembly construction may achieve a very fine spray mist ("atomization") of the fuel and may provide significant vaporization and mixing prior to entry of the fuel/air mixture to recirculation region 34 of combustion zone 32 through nozzle assembly outlet 52.

Further, and with continued reference to FIG. 1, a plurality of swirl vanes 54 are disposed about the circumference of nozzle 42. Swirl vanes 54 are also fed by compressed air from plenum 50 and cause swirling of the fuel/air mixture leaving outlet 52 further increasing mixing and vaporization. Also, a second source 60 of fuel, such as an easily vaporized substance e.g. ethanol, may be provided to be mixed with fuel from source 44 to assist in combustion at part load, e.g. 60% or less of rated power. It may be preferred to mix the fuels upstream of nozzle assembly 40 as depicted in FIG. 1. One skilled in the art can provide appropriate valving and fuel controllers given the present disclosure. Alternatively, or additionally, air control apparatus, e.g., bleeding or variable geometry, may be employed to reduce the total air mass flow during such part load operation.

Still further in accordance with the present invention, as embodied and broadly described herein, the can combustor may further include an impingement cooling sleeve coaxially disposed in the compressed air passage between the housing and the combustor liner and surrounding at least the combustion zone. The impingement cooling sleeve may have a plurality of orifices sized and distributed to direct compressed air against the radially outer surface of the portion of the combustor liner defining the combustion zone, for impingement cooling. Essentially all of the compressed air received at the housing inlet passes through the sleeve.

As embodied herein, and with reference again to FIG. 1, impingement cooling sleeve 70 is coaxially disposed between housing 12 and liner 24. Impingement cooling sleeve 70 extends axially along a portion of liner 24 from a location 72 downstream of dilution ports 30, relative to the general axial flow direction 74 of the combustion gases, to a location 76 on housing 12 adjacent closed end 22. Sleeve 70 includes a plurality of impingement cooling orifices 78 distributed circumferentially around sleeve 70 and configured and oriented to direct combustion air in passage 26 against the outer surface 24*a* of liner 24 in the vicinity of combustion zone 32. The space 80 between sleeve 70 and liner 24 comprises the downstream region for the compressed air flow after it has traversed sleeve 70 through impingement cooling orifices 78 and impingement cooled surface 24*a*.

As can best be seen in FIG. 1, the compressed air from sleeve downstream region 80 is channeled both in a direction 82 to provide combustion air for combustion zone 32 substantially through a plurality of primary holes 84, and also in a direction 86 to dilution air path 28, to provide dilution air substantially through dilution openings 30. Also, primary holes 84 can be configured with inwardly directed spout-shaped, wall extensions 84*a* to promote penetration into combustion zone 32.

It may also be preferred that plenum region 50 in the closed "head" end 22 of combustion housing 12 be supplied with compressed air from sleeve downstream region 80, and such is depicted in FIG. 1 by flow path 90. Noteworthy in the FIG. 1 embodiment is that the compressed air for air blast nozzle 42 is driven solely by the pressure differential between plenum 50 and the recirculation portion 34 of combustion zone 32. No separate supply of compressed air is required to operate nozzle 42, thereby simplifying the overall system, although the scope of the present invention in its broadest aspects is not so limited.

Still further, it may be preferred to use a portion of the compressed air in plenum 50 for impingement cooling of entrance portion 94 of liner 24. In the FIG. 1 embodiment, entrance portion 94 is conically tapered and includes inwardly spaced conical shield member 96. Suitably sized and directed orifices 98 are distributed around liner entrance portion 94 and directed to impingement cool shield 96, using compressed air from plenum 50. After cooling shield 96, the fraction of the compressed air from plenum 50, that is, the part not used to operate air blast nozzle 42, is admitted to region 34 of combustion zone 32 through liner inlet 100 along flow path 102, for use as combustion air.

It may yet be further preferred that a fraction of the dilution air flow be used to impingement cool a transition portion of the liner between the combustion zone and the dilution zone. In FIG. 1, transition liner portion 110 is conically tapered and converging in flow direction 74, and is provided with an inwardly spaced conical transition shield 112. A plurality of impingement cooling orifices 114 are distributed about transition liner portion 110, and are sized and directed to impingement cool transition shield 112 using a fraction of the compressed air flowing in dilution air passage 28. After cooling transition shield 112, the dilution air fraction is admitted to dilution zone 36 at transition shield exit 118.

Still further, it may be preferred to coat surface 120 of liner portion 24*a* with a thermal barrier coating ("TBC") to maintain high liner inner surface temperatures while preventing undue heat loss from combustion zone 32 and possible significant temperature deviations in the local combustion gas temperature near the liner wall from bulk average combustion zone values. The TBC coating also reduces the amount of sediment and unburned fuel on the liner inner surface. One skilled in the art would be able to select an appropriate TBC given the present disclosure.

In the embodiment depicted in FIG. 1, essentially all of the compressed air delivered through inlet 18 first passes through orifices 78 of impingement sleeve 70 to provide cooling for liner portion 24*a*, and there after is admitted to combustion zone 32 as "combustion air" or to dilution zone 36 as "dilution air", that is, all except possibly unavoidable leakage.

It may be further preferred to configure combustor 10 of the FIG. 1 embodiment such that, when combusting low calorific liquid fuels such as pyrolysis oil having a calorific value of about 18.7 MJ/kg, about 5-15% of the total compressed air mass flow from inlet 18 enters combustion zone 32 through primary ports 84, and that about 60-70% enters dilution zone 36 via dilution ports 30. As would be appreciated, the remainder portion (~15-35%) of the total mass flow of compressed air entering combustor inlet 18 is used for operation of air blast nozzle 42 and to impingement cool liner entrance shield 96 and/or liner transition shield 112. Also, in such an application the can combustor preferably would be configured with an L/D of about 1.65, and a V/Q of about $$0.0029\ \frac{\mathrm{m}^3 \cdot \mathrm{sec}}{\mathrm{MJ}}.$$

The fuel mass flow rate at rated power in such an application would be about 0.387 kg/sec and the combustion zone volume about 0.021 $m^3$.

It will be apparent to those skilled in the art that various modifications and variations can be made in the disclosed impingement cooled can combustor, without departing from the teachings contained herein. Although embodiments will be apparent to those skilled in the art from consideration of this specification and practice of the disclosed apparatus, it is intended that the specification and examples be considered as exemplary only, with the true scope being indicated by the following claims and their equivalents.

What is claimed is:

1. A can combustor for burning fuels with low calorific values, the combustor comprising:

a generally cylindrical housing having an interior, a longitudinal axis, an annular inlet for receiving compressed air at one longitudinal housing end with the other longitudinal housing end being closed;

a generally cylindrical combustor liner coaxially disposed in the housing interior, the liner and the housing defining a generally annular flow passage for the compressed air received through the housing inlet, an interior of the liner defining a combustion zone adjacent the closed housing end and a dilution zone distant the closed housing end;

a fuel nozzle assembly disposed at the closed end, the nozzle assembly being supplied from a source of fuel having a calorific value of less than about 25 MJ/kg;

an impingement cooling sleeve disposed in the compressed air passage surrounding the liner portion defining the combustion zone, the sleeve having a plurality of orifices sized and configured to impingement cool an outer surface of the liner portion with essentially all of the compressed air received at the housing inlet passing through the sleeve;

a plurality of primary holes circumferentially disposed in the liner for introducing a first portion of the compressed air from a region downstream of the impingement cooling sleeve into the combustion zone;

a plurality of dilution openings circumferentially disposed in the liner for introducing a second portion of the compressed air from the region downstream of the impingement cooling sleeve into the dilution zone, wherein at least part of a remainder portion of the compressed air from the region downstream of the impingement cooling sleeve is channeled through the fuel nozzle assembly for mixing with the supplied fuel to provide a fuel/air mixture directed into the combustion zone, and wherein the liner is sized to have an L/D ratio in the range $1.00 \leq L/D < 4.00$, where L is a liner length and D is a liner diameter.

2. The can combustor as in claim 1, wherein $1.5 \leq L/D < 2.5$.

3. The can combustor as in claim 1 wherein the first portion of compressed air is 5-15% of a total compressed air mass flow rate.

4. The can combustor as in claim 1, wherein the second portion of compressed air is 60-70% of a total compressed air mass flow rate.

5. The can combustor as in claim 1, wherein the fuel nozzle assembly includes an air blast nozzle, and wherein the nozzle assembly is configured to use a part of the remainder air portion of the compressed air to direct the fuel/air mixture into the combustion zone using a compressed air pressure differential between the region downstream of the impingement cooling sleeve and the combustion zone.

6. The can combustor as in claim 5, wherein the fuel nozzle assembly is disposed coaxially with the liner and includes swirl vanes distributed circumferentially about an exit of the nozzle assembly to induce swirling in the directed fuel/air mixture using another part of the remainder air portion.

7. The can combustor as in claim 1, wherein the fuel nozzle assembly and the liner are sized and configured to inject and burn liquid pyrolysis oil.

8. The can combustor as in claim 7, wherein the fuel nozzle assembly includes an air blast nozzle; wherein L/D is about 1.65.

9. The can combustor as in claim 7, wherein the source of fuel includes a light weight alcohol mixed with the pyrolysis oil for combustor operation at less than about 60% rated power.

10. The can combustor as in claim 1, wherein the primary holes have spout-shaped wall extensions into the combustion zone.

11. The can combustor as in claim 1, wherein a surface of the liner is coated with TBC to increase the inside surface temperature.

12. The can combustor as in claim 1, wherein the liner includes a tapered inlet portion adjacent an exit of the fuel nozzle assembly; wherein the liner further includes an entrance shield member coaxially disposed within, and spaced from, the tapered inlet liner portion; and wherein a plurality of impingement cooling orifices are provided in the tapered liner portion sized and directed to impingement cool the entrance shield member using compressed air from the sleeve downstream region.

13. The can combustor as in claim 1, wherein the liner includes a tapered transition portion disposed between the combustion zone and the dilution zone; wherein the liner further includes a transition shield member coaxially disposed within, and spaced from, the tapered transition liner portion; and wherein a plurality of impingement cooling orifices are provided in the tapered transition liner portion, the orifices being sized and directed to impingement cool the transition shield member using compressed air from the sleeve downstream region.

14. The can combustor as in claim 1, wherein the impingement cooling sleeve extends from a location on the liner downstream of the dilution ports to a location on the housing upstream of the combustion zone, relative to a flow direction of combustion gases.

15. A gas turbine engine having the can combustor of claim 1 operatively interconnected between an air compressor and a gas turbine.

16. A can combustor for burning a liquid fuel with a low calorific value, the combustor comprising:

a generally cylindrical housing having an interior, longitudinal axis, an angular inlet for receiving compressed air at one longitudinal housing end with the other longitudinal housing end being closed;

a generally cylindrical combustor liner and the housing defining a generally annular flow passage for the compressed air received through the housing inlet, an interior of the liner defining a combustion zone adjacent the closed housing end and a dilution zone distant the closed housing end;

a fuel nozzle assembly disposed at the closed end, the nozzle assembly being supplied from a source of liquid fuel having a calorific value of less than about 25 MJ/kg, the nozzle assembly being configured to provide a fuel spray;

an impingement cooling sleeve disposed in the compressed air passage surrounding the liner portion defining the combustion zone, the sleeve having a plurality of orifices sized and configured to impingement cool an outer surface of the liner portion with essentially all of the compressed air received at the housing inlet passing through the sleeve;

a plurality of primary holes circumferentially disposed in the liner for introducing a first portion of the compressed air from a region downstream of the impingement cooling sleeve into the combustion zone;

a plurality of dilution openings circumferentially disposed in the liner for introducing a second portion of the compressed air from the region downstream of the impingement cooling sleeve into the dilution zone, wherein at least part of a remainder portion of the compressed air from the region downstream of the impingement cooling screen is channeled through the fuel nozzle assembly for mixing with the fuel spray to provide a fuel/air mixture directed into the combustion zone, wherein the fuel nozzle assembly includes an air blast nozzle, and wherein the nozzle assembly is configured to use a part of the remainder air portion of the compressed air to direct the fuel/air mixture into the combustion zone using a compressed air pressure differential between the region downstream of the impingement cooling sleeve and the combustion zone, wherein the fuel nozzle assembly is disposed coaxially with the liner and includes swirl vanes distributed circumferentially about an exit of the nozzle assembly to induce swirling in the directed fuel/air mixture using another part of the remainder air portion, wherein the liner is sized to have an L/D ratio in the range $1.5 \leq L/D \leq 2.5$ where L is a liner length and D is a liner diameter.

17. The can combustor as in claim 16 wherein the first portion of compressed air is 5-15% of a total compressed air mass flow rate.

18. The can combustor as in claim 16, wherein the second portion of compressed air is 60-70% of a total compressed air mass flow rate.

19. The can combustor as in claim 16, wherein the liquid fuel is pyrolysis oil having a calorific value of about 7 MJ/kg; wherein the L/D ratio is about 1.65.

20. A gas turbine engine having the can combustor as in claim 16 operatively interconnected between an air compressor and a gas turbine.

* * * * *